United States Patent [19]

Shy

[11] Patent Number: 4,756,051

[45] Date of Patent: Jul. 12, 1988

[54] DOOR-CLOSER HINGE WITH ROTARY-MOVEMENT SHOCK ABSORBER

[76] Inventor: Haw-Yaw Shy, 762, Chung Hua Rd., Sec. 1, Taitung, Taiwan

[21] Appl. No.: 6,236

[22] Filed: Jan. 23, 1987

[51] Int. Cl.[4] ..... E05F 3/20; E05F 1/12; E05F 5/02

[52] U.S. Cl. ..... 16/50; 16/54; 16/76; 16/82; 16/299; 16/304

[58] Field of Search ..... 16/52, 54, 50, 68, 76, 16/82, 84, 299, 300, 304

[56] References Cited

U.S. PATENT DOCUMENTS 2,018,564 10/1935 Milly ..... 16/54

3,952,365 4/1976 Grisebach ..... 16/52

*Primary Examiner*—Nicholas P. Godici

*Assistant Examiner*—Edward A. Brown

[57] ABSTRACT

A door-closer hinge includes a first flap secured to a door, a second flap secured to a door frame, and an automatic closer as restored by a restoring spring and having a longitudinal casing secured to the second flap, in which a rotor vane fixed on a rotor having a needle passage formed in the rotor is operatively rotated with respect to a cylinder vane fixed inside a cylinder which is filled with a hydraulic oil and disposed around the rotor to thereby form a rotary-movement shock absorber for quickly opening a door when the oil is rotatably driven to contract the two vanes for quick flow of oil to the left, or for slowly closing the door when the oil is slowly returned to the right to expand the two vanes to allow oil flow merely through the smaller needle passage in the rotor.

5 Claims, 4 Drawing Sheets

DOOR-CLOSER HINGE WITH ROTARY-MOVEMENT SHOCK ABSORBER

BACKGROUND OF THE INVENTION

A conventional door-closer as shown in FIGS. 9 and 10 operates on the principle of a shock absorber in which a piston P moves in a cylinder for forcing oil through small openings respectively provided in the piston and cylinder. When the door is opened, the piston is withdrawn and the oil in the cylinder opens a ball valve in a passage provided in the piston and flows into the space to the right of the piston (FIG. 9). When the door is released, it is closed by the action of the spring and the piston travels back to the right and forces the oil through the return passages (FIG. 10) into the space to the left of the piston to gradually slow down the closing of the door because the oil escape is progressively cut off by the advance of the piston.

However, such a conventional door-closer still has the following defects:

1. The piston P is reciprocatively moved within the cylinder as actuated by a spindle S and a link means M to form a gigantic structure and complex mechanism to thereby increase the production cost, installation space and maintenance problems.

2. The door can only be opened or closed in a single direction to limit its application, for instance, in a two-way (in-and-out) door system.

3. The force to open a door is not always normal to the force arm (not forming 90°) to thus consume much energy and to easily cause tiredness for a door opener.

The present inventor has found the defects of a conventional door-closer and invented the present door-closer hinge with rotary-movement shock absorber.

SUMMARY OF THE INVENTION

The object of the present invention is to provide a door-closer hinge including a first flap adapted to fix on a door, an automatic closer having an upper cylinder and a rotor rotatably moving in the upper cylinder, and a second flap adapted to fix on a door frame, wherein upon the opening of a door having the door-closer hinge provided thereon, a hydraulic oil filled in the upper cylinder will flow to the left through an aperture between a cylinder vane and the rotor and the other aperture between a rotor vane and the cylinder for quick opening of the door; and upon the closing of the door the oil will flow back to the right through needle passages formed in the rotor for slow closing of the door.

DETAILED DESCRIPTION

Figure 1:
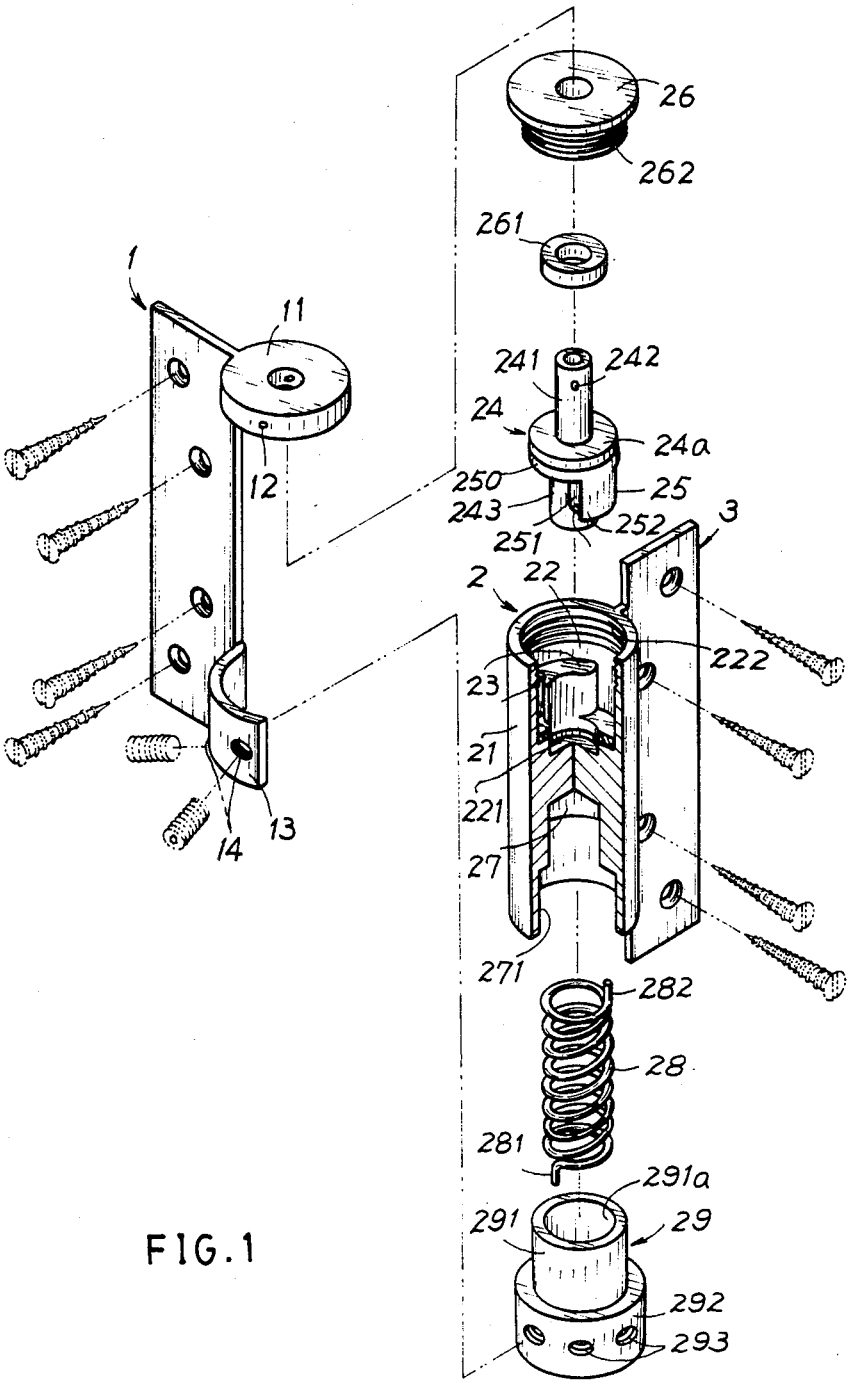
FIG. 1 is a perspective view showing all elements forming the present invention.
Figure 2:
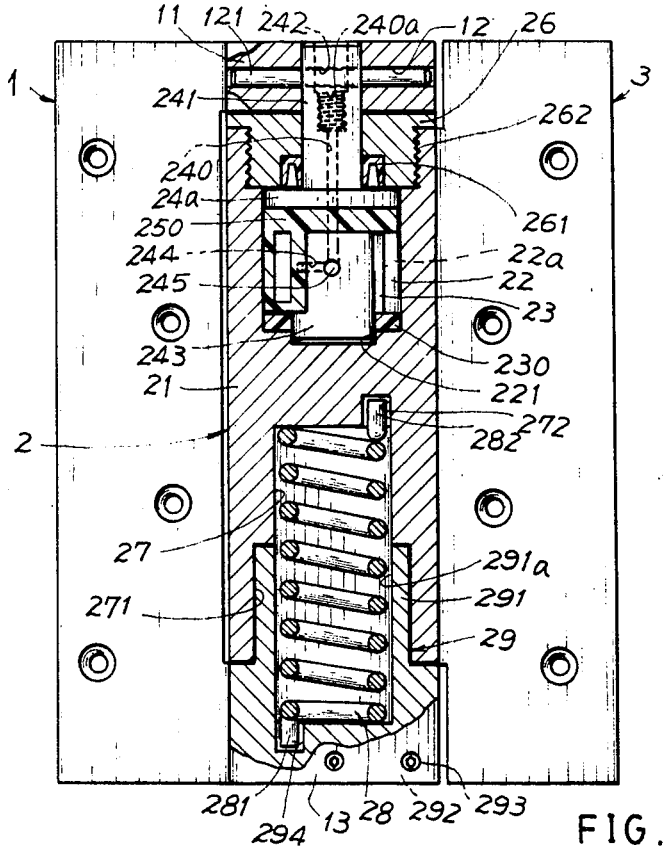
FIG. 2 is a sectional drawing of the present invention.
Figure 3:
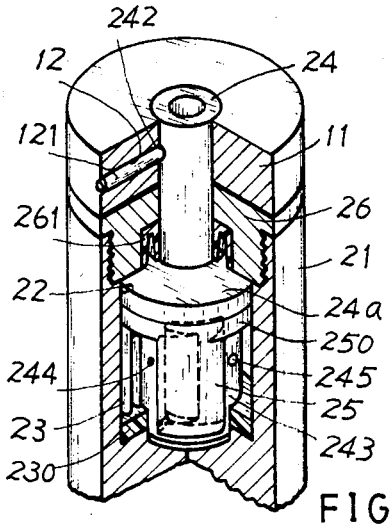
FIG. 3 is a partial cut-away illustration of the present invention.

As shown in FIGS. 1–7, the present invention comprises: a first flap 1 having an upper collar 11 transversely drilled with a pin hole 12 and a lower arched leaf 13 having several screw holes i4 horizontally formed on the leaf 13, adapted to fix on a door D by screws; an automatic closer 2; and a second flap 3 opposite to the first flap 1 having the automatic closer 2 fixed thereon and adapted to fix on a door frame F. The first flap 1 may also be secured to the door frame and the second flap 3 may be secured to a door.

The automatic closer 2 includes: a longitudinal casing 21 secured to the second flap 3, an upper cylinder 22 formed on the upper portion of casing 21 having a lower rotor hole 221, a cylinder vane 23 having a V-shaped cross section and made of elastomer materials such as rubber, a rotor 24, a rotor vane 25 having a V-shaped cross section and made of elastomer materials, a cap 26 having a packing ring 261 and formed with a male-threaded portion 262 to engage with a female-threaded hole 222 of the upper cylinder 22, a lower cylindrical chamber 27 formed on the lower portion of casing 21 and having a cylindrical hole 271 rotatably engaged with a cylindrical shaft portion 291 of a lower plug 29, a restoring spring 28 having its one end 272 secured to the cylindrical chamber 27 and having the other end 281 thereof secured to the plug 29, and the lower plug 29 having the cylindrical shaft portion 291 formed with a hollow portion **291*a* for jacketing the spring 28 therein and having a lower collar 292 drilled with plural screw holes 293 selectively matching with the screw holes 14 formed on leaf 13 for adjustably combining the leaf 13 with the collar 292 by screws 141 with regard to the restoring condition of the spring 28**.

The cylinder vane 23 having V-shaped cross section includes an inner wing 231 adhered (either chemically or mechanically) on a cylindrical wall of the upper cylinder 22, an outer wing 232 having its divergent end **232*a* protruding counter-clockwise and resiliently contacting the cylindrical surface of a lower rotor portion 243 of rotor 24 and having its convergent end 233 tapered in a direction opposite to the protruding direction of the divergent end 232*a* to integratedly combine with the inner wing 231, and a web sealer 234 formed on the upper edge of the vane 23 as defined between the two wings 231, 232 to serve as an extendible sealer of the vane under boosting pressure of a hydraulic oil 22*a* filled in the cylinder 22. The lower edge of the vane 23 is formed with an annular packing ring 230** for oil sealing.

The rotor 24 includes an upper spindle 241 protruding upwards from a central disk **24*a* to rotatably engage with a central hole 263 of the cap 26 and uttermostly secured to the upper collar 11 by a pin 121 through a hole 242 formed on spindle 241 and the hole 12, a lower rotor portion 243 rotatably engaged with the lower rotor hole 221 of upper cylinder 22, a pair of needle passages 244, 245 separated in an angle about 90 degrees and commonly communicated with a central vertical hole 240 which also serves as a vent formed through the upper spindle 241** for air releasing when first filling oil 22*a* into cylinder 22 when assemblying the present invention. The vent is sealed by an upper plug 240*a* passing through a central hole of the upper collar 11.

Figure 4:
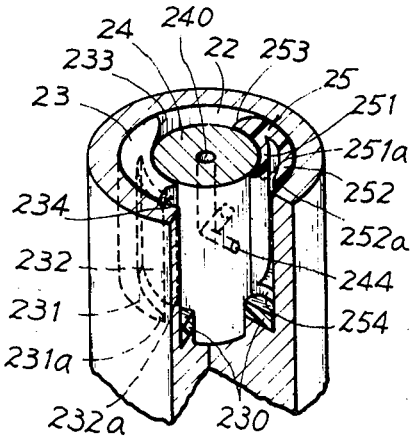
FIG. 4 is a partial cut-away illustration showing the rotor and the upper cylinder of the present invention.
Figure 5:
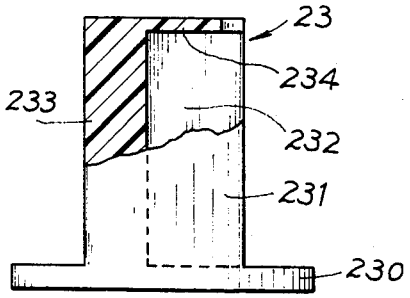
FIG. 5 shows a cylinder vane of the present invention.
Figure 6:
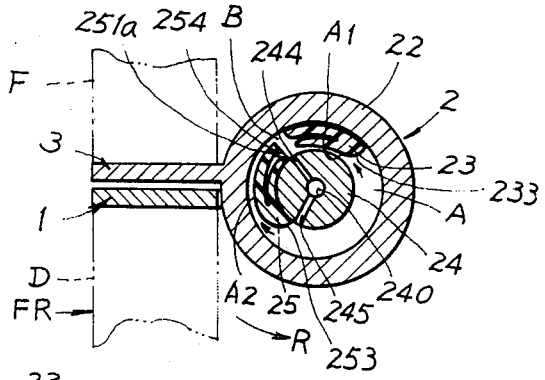
FIG. 6 is an illustration showing the tendency to open a door provided with the present invention.

The rotor vane 25 having a V-shaped cross section includes a top disk 250 adhered under the central disk 24*a*, an inner wing 251 adhered on the cylindrical surface of the rotor portion 243 and having its rear end 251*a* positioned near an outlet of one needle passage 244, an outer wing 252 having its divergent end 252*a* protruding clockwise to resiliently contact the cylindrical wall of the upper cylinder 22 and having its convergent end 253 tapered to integratedly combine with the front end of the inner wing 251 and positioned near an outlet of the other needle passage 245 as shown in FIGS. 6 and 4, and a web sealer 254 formed on the lower edge of the vane 25 as defined between the two wings 251, 252 to serve as an extendible oil sealer to prevent oil escape through possible aperture between the vane 25 and the cylinder 22.

Figure 7:
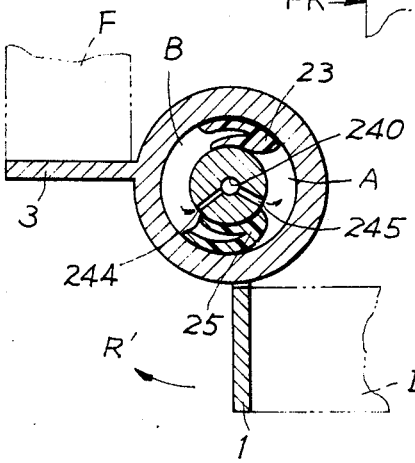
FIG. 7 shows the tendency to close a door provided with the present invention.
Figure 8:
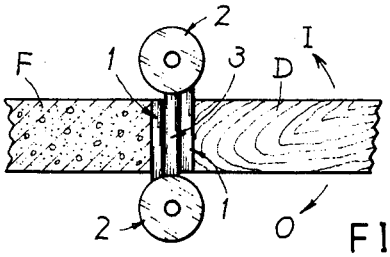
FIG. 8 shows a combination of a pair of door-closer hinges in accordance with the present invention.
Figure 9:
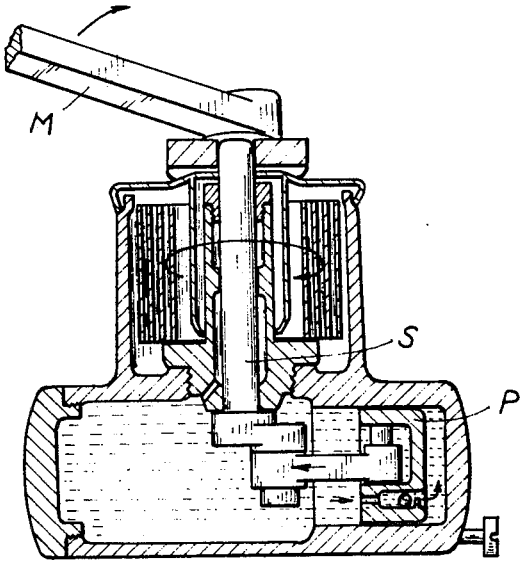
FIG. 9 PRIOR ART
FIG. 9 shows a conventional door-closer when opening a door.
Figure 10:
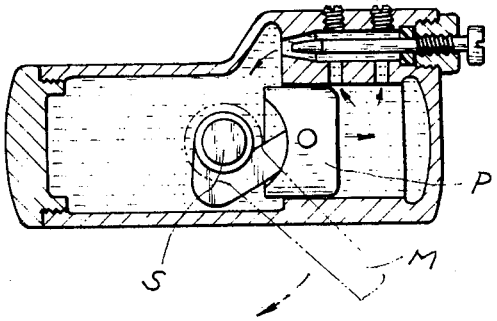
FIG. 10 PRIOR ART
FIG. 10 shows a conventional door-closer when closing a door.

The width of either vane 25 or vane 23 should be less than a quadrant of the cross section of the cylinder 22. The present invention can be applied either for a single door as shown in FIGS. 6 and 7, or for a two-way door system as shown in FIG. 8 for in-and-out bi-directional service (I,O) in which the second flap 3 can be common to either hinge. The present invention can also be installed in an underground construction by those skilled in the art. When opening a door provided with the present invention, the force FR for opening a door is normally perpendicular (90°) to the force arm from the axis of the hinge towards the perimeter of the cylinder 21 to obtain a maximum momentum for circular movement, to thereby be helpful for easier opening of a door.

When using the present invention such as opening a door D as shown in FIG. 6, the opening force FR is applied on the door D and flap 1 and fixed rotor 24 is rotated in direction R to boost (rotatably drive) the oil 22*a* in right chamber A to flow through either an aperture A1 between the vane 23 and the rotor 24 or an aperture A2 between the vane 25 and the cylinder 22 into chamber B. The divergent end 252*a* of outer wing 252 and the divergent end 232*a* of outer wing 232 can be resiliently contracted by the oil pressure to thereby easily form such apertures A1, A2 for quick flow of oil from chamber A into chamber B for quick door-opening.

When closing the door as shown in FIG. 7, the oil in chamber B will then be boosted to expand both outer wings of the two vanes 23, 25 to allow oil flowing from chamber B into A through the needle passages 244, 245. The needle passages 244, 245 are made so small to thereby slow down the closing operation of the door to enhance the performance of a shock absorber. The aperture A1 or A2 should be greatly larger than the diameter of the needle passage 244 or 245.

Accordingly, the present invention is superior to a conventional door-closer with the following advantages:

1. The door opening of the present invention is more convenient with less energy consumption since a maximum momentum can be easily obtained as the opening force is always normal to its force arm.

2. The automatic closer is formed as a compact rotary unit as the cylindrical casing 21 for saving cost, space and minimizing maintenance problems.

3. A bi-directional door-opening mechanism can be easily obtained by utilizing the present invention.

The present invention is not merely limited in the application of an automatic door closer. Other hydraulic systems such as used in a shock absorber or a quick-and-slow rotary motion can be achieved by modifying the structure or mechanism of the present invention.

Those modifications are still within the scope of this invention.

I claim:

1. A door-closer hinge with a rotary-movement shock absorber comprising:

a first flap having an upper collar and a lower arched leaf, adapted to fix on a door;

a second flap opposite to the first flap and adapted to fix on a door frame; and an automatic closer including:

a longitudinal casing secured to said second flap; an upper cylinder formed on an upper portion of said casing and filled with a hydraulic oil therein; a cylinder vane made of elastomer materials having V-shaped cross section and having an inner wing adhered on a cylindrical wall of said upper cylinder, an outer wing having its divergent end protruding counter-clockwise and resiliently contacting a rotor and having its convergent end tapered in a direction opposite to the protruding direction of the divergent end to integratedly combine with said inner wing, a web sealer formed on the upper edge of said cylinder vane as defined between said two wings of said cylinder vane and an annular packing ring formed on the lower edge of said cylinder vane; a rotor having an upper spindle protruding upwards from a central disk to rotatably engage with a cap fixed on the top end of said upper cylinder and to be uttermostly secured to said upper collar, a pair of needle passages separated in about 90 degrees as formed in said rotor and commonly communicated with a central hole formed through said upper spindle in which said central hole is sealed by an upper plug passing through said upper collar and in which two said neede passages having two outlets respectively positioned near two ends of an inner wing of a rotor vane; the rotor vane made of elastomer materials having a V-shaped cross section and having the inner wing adhered on the rotor, an outer wing having its divergent end protruding clockwise to resiliently contact a cylindrical wall of said upper cylinder and having its convergent end integratedly combined with a front end of said inner wing, and a web sealer formed on the lower edge of said rotor vane as defined between two said wings of said rotor vane; a lower cylindrical chamber formed on the lower portion of said casing rotatably engaged with a lower plug adjustably fixed on said lower arched leaf of said first flap; and a restoring spring having its one end secured to said casing and having the other end thereof secured to said lower plug, whereby upon the opening of a door provided with said hinge, the hydraulic oil in said upper cylinder will be forced from the right to the left through an aperture between said rotor vane and said upper cylinder and the other aperture between said cylinder vane and said rotor for quick opening of the door; and upon the closing of the door as restored by said restoring spring, the oil will be returned back to the right by passing through said needle passages for slow closing and shock absorbing purpose.

2. A door-closer hinge according to claim 1, wherein the width of either said cylinder vane or said rotor vane is less than a quadrant of a cross section of said upper cylinder.

3. A door-closer hinge according to claim 1, wherein the aperture operatively formed by either said rotor vane or said cylinder vane is larger than the diameter of each said needle passage of said rotor.

4. A door-closer hinge according to claim 1, wherein a packing ring is formed under said cap of said upper cylinder to serve as an oil sealer therefor.

5. A combination of a pair of door-closer hinges as restricted in claim 1, wherein a first flap of a first hinge is secured to a door frame and a first flap of a second hinge opposite to said first hinge is secured to a door, and a second flap of each said hinge is commonly secured to both said hinges so as to form a two-way door adapted for its in-and-out bi-directional opening or closing service.

* * * * *